US006618864B2

(12) United States Patent
Veal

(10) Patent No.: US 6,618,864 B2
(45) Date of Patent: Sep. 16, 2003

(54) AUTOMATIC FLUSHING AND SEAT RAISING ARRANGEMENTS FOR TOILETS

(76) Inventor: Bennie N Veal, 6621 Park Valley Dr., Clarkston, MI (US) 48348

( * ) Notice: Subject to any disclaimer, the term of this patent is extended or adjusted under 35 U.S.C. 154(b) by 0 days.

(21) Appl. No.: 09/827,343

(22) Filed: Apr. 6, 2001

(65) Prior Publication Data

US 2002/0029412 A1 Mar. 14, 2002

Related U.S. Application Data

(60) Provisional application No. 60/194,860, filed on Apr. 6, 2000.

(51) Int. Cl.[7] ..... E03D 5/10
(52) U.S. Cl. ..... 4/406; 4/313
(58) Field of Search ..... 4/313, 406, DIG. 3, 4/249, 250, 246.1

(56) References Cited

U.S. PATENT DOCUMENTS 407,746 A * 7/1889 Stevens ..... 4/406 X
668,990 A * 2/1901 Jenkins ..... 4/406 X
3,559,217 A * 2/1971 Johnson ..... 4/406
4,141,091 A * 2/1979 Pulvari ..... 4/313
4,392,260 A * 7/1983 Bensen ..... 4/406 X

FOREIGN PATENT DOCUMENTS

WO 9313275 * 7/1993 ..... 4/406

* cited by examiner

*Primary Examiner*—Robert M. Fetsuga
(74) *Attorney, Agent, or Firm*—Millen, White, Zelano & Branigan, P.C.

(57) ABSTRACT

Automatic flushing, lid raising and seat raising arrangements for toilets include a tank top having optical sensors integral therewith so that standard flush tanks and tops may be used with only the tops being slightly altered to accommodate the optical sensors. The flushing arrangement is readily mountable on standard overflow pipes and provides automatic flushing while also allowing manual flushing. The lid and seat raising and lowering actuators are arranged in a single unit readily attachable to a standard toilet bowl using substantially standard lids and seats.

18 Claims, 16 Drawing Sheets

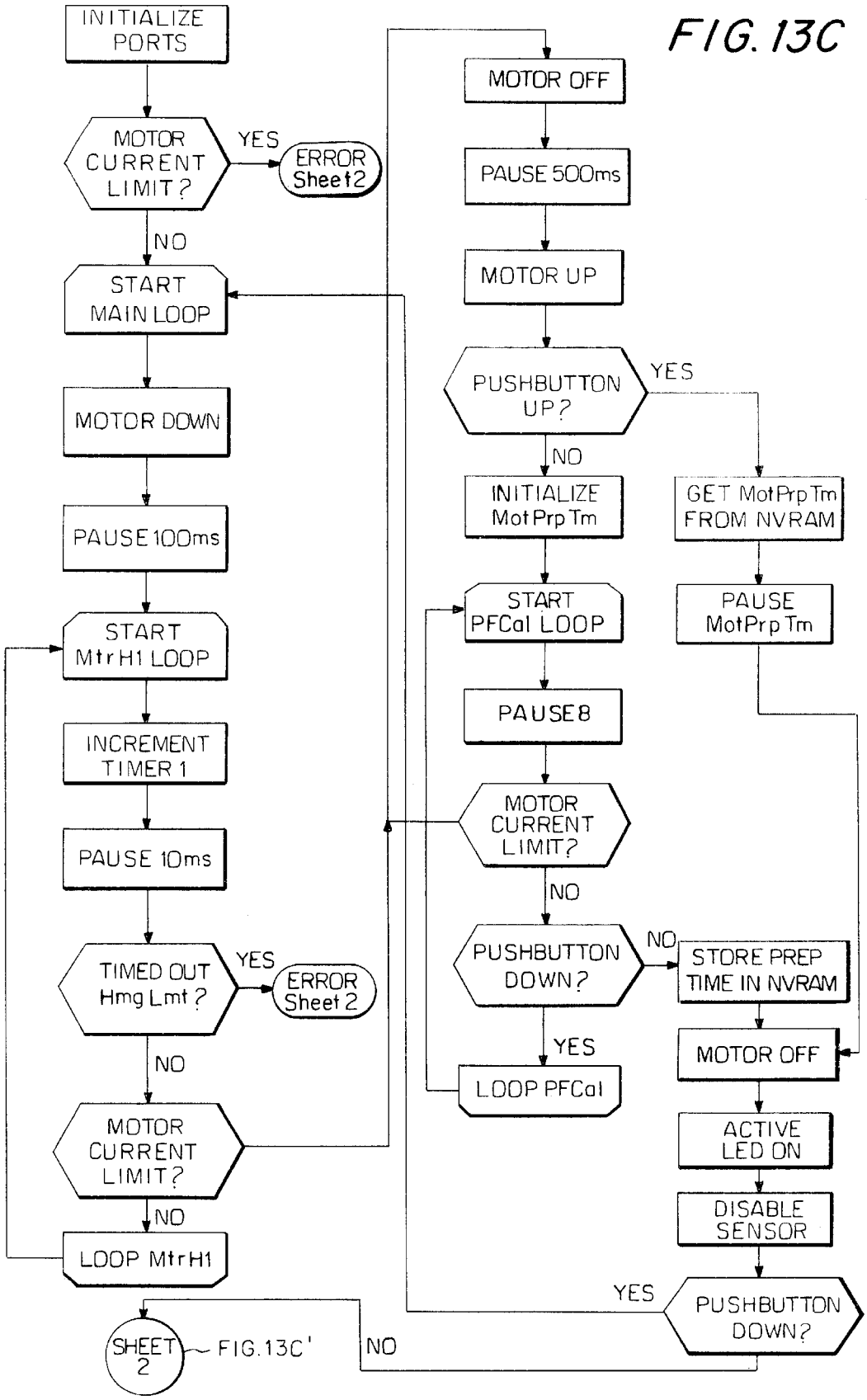
FIG. 13C
INITIALIZE PORTS
MOTOR CURRENT LIMIT?
YES
ERROR Sheet2
NO
START MAIN LOOP
MOTOR DOWN
PAUSE 100ms
START MtrH1 LOOP
INCREMENT TIMER 1
PAUSE 10ms
TIMED OUT Hmg Lmt?
YES
ERROR Sheet 2
NO
MOTOR CURRENT LIMIT?
NO
LOOP MtrH1
SHEET 2
FIG. 13C'
MOTOR OFF
PAUSE 500ms
MOTOR UP
PUSHBUTTON UP?
YES
NO
INITIALIZE MotPrpTm
GET MotPrpTm FROM NVRAM
START PFCal LOOP
PAUSE MotPrpTm
PAUSE 8
MOTOR CURRENT LIMIT?
NO
PUSHBUTTON DOWN?
NO
STORE PREP TIME IN NVRAM
YES
LOOP PFCal
MOTOR OFF
ACTIVE LED ON
DISABLE SENSOR
YES
PUSHBUTTON DOWN?
NO

AUTOMATIC FLUSHING AND SEAT RAISING ARRANGEMENTS FOR TOILETS

RELATED PATENT APPLICATIONS

This application claims priority from provisional patent application Ser. No. 60/194,860 filed Apr. 6, 2000 under 35 U.S.C. §119 and incorporated herein in its entirety by reference.

FIELD OF THE INVENTION

This invention relates generally to automatic flushing and seat raising arrangements for toilets. More particularly, this invention relates to automatic flushing and automatic lid and seat raising arrangements for toilets which can be incorporated as original equipment or retrofitted to existing toilets.

BACKGROUND OF THE INVENTION

As set forth in Applicant's U.S. Pat. No. 5,603,127, incorporated in its entirety herein by reference, it is generally desirable to be able to use a toilet without touching the toilet or at least touching the toilet as little as possible. For health reasons, both real and imagined, it is especially desirable to minimize or eliminate touching of a toilet or any of its components by hand. Hands come into contact with not only food and eating utensils, but with other people. It is well known that toilets harbor microorganisms for numerous diseases from dysentery to hepatitis. Moreover, it is well known that many people are not in the habit of washing their hands after using a toilet. Consequently, avoidance of touching the surfaces of toilets can help break disease transmission chains. While having touch free toilets in homes is certainly desirable for many reasons, public touch free toilets are highly desirable because the users do not know one another and are not in constant contact and proximately with one another, other than through common toilet use.

It is of course, highly desirable to have automatic flush and automatic lid and seat raising arrangements which are not only usable with newly manufactured toilets, but also with the millions of toilets, both public and private, which already exist.

Toilet seat arrangements are generally standard with one manufacturer's seats and lids being hinged on toilet bowls using a pair of bolts in substantially the same way as another manufacturer's lids and seats. This is not the case with flush mechanisms. However, practically all toilets which use a flush tank have overflow tubes and liftable valves which close flush tank outlets that dump water at a rapid rate from the flush tanks into toilet bowls. In view of these considerations, there is a need for automatic flushing as well as automatic seat/lid raising and lowering arrangements which are readily adaptable to both original equipment and existing installations.

SUMMARY OF THE INVENTION

In one aspect of the present invention, it is directed to touch free arrangements for automatically raising and lowering toilet lids and seats and/or for automatically flushing toilets upon sensing an approach of a person intending to use the toilet and upon sensing the departure of that person after using the toilet. In accordance with this aspect of the invention, an optical sensing arrangement is disposed in a flush tank top so that in order to use the system, one need only replace an existing or conventional flush tank top with flush tank top in accordance with the present invention. In a more specific aspect of this sensing arrangement, the new flush tank top includes a pair of optical sensors which have a sensing axes that converge to a point in front of the toilet, wherein the sensors activate the lid and/or seat as a person approaches the toilet to raise the lid and/or seat and lowers the lid and/or seat when the person moves away from the toilet. The sensing arrangement also preferably initiates flushing the toilet after the person moves away.

In still a further aspect of the invention, the flush tank top includes a vertically oriented optical sensor which detects the presence of a person's hand which can optionally flush the toilet without touching the flush handle or can optionally raise or lower the seat and/or lid without touching either.

In accordance with a further aspect of the invention, an automatic flushing actuator is adapted to be mounted on an overflow pipe in a flush tank of a toilet in which the flush tank includes an outlet normally closed by a valve. The automatic flushing actuator comprises a housing adapted to the mounted on the overflow pipe and an operator mounted on the housing. The operator is adapted to be coupled to the valve for allowing the valve to remain closed when the operator is in a first mode and for opening the valve when the operator is in the second mode. A motor mounted in the housing is coupled to the operator through a first-lost motion connection for causing the operator to cycle from the first mode to the second mode and back to the first mode. A second lost-motion connection couples the operator to the manual flush device for manually shifting the operator from the first mode to the second mode without energizing the motor.

In a more specific aspect, the first lost motion connection of the automatic flush actuator comprises a cam driven by the motor to cycle through two positions corresponding to the first and second modes of the operator. The first lost-motion connection includes a coupling between the cam and the operator with the coupling positively coupling with the operator when the cam is cycling through the two positions and decoupling from the cam when the operator is in the first mode.

In still a further aspect of the invention, the coupling of the first loss motion connection is a cam follower which rests on the operator and always allows the operator to move from the first mode to the second mode when pressing the manual flush device.

In a preferable aspect of the invention, the operator is a lever which is pivoted with respect to the housing, the lever having a long portion and a short portion, with the long portion being connected to the valve and the short portion being in engagement with the cam follower, wherein when the cam follower is driven by the cam, it causes the lever to lift and open the valve.

In still a further aspect of the invention, the lever of the operator is connected to the flush handle device wherein when the flush handle device is operated, the operating lever is lifted independently of the cam follower so as to open the valve manually without energizing the motor of the automatic flush operator.

The invention further includes a device for automatically raising and lowering a toilet lid, and optionally, a seat possibly in cooperation with the aforedescribed automatic flush actuator. This device comprises an arrangement for sensing the presence of a person and includes a base to be secured to the toilet bowl adjacent the rim thereof as well as a housing attached to the base. A drive assembly is positioned within the housing. The drive assembly includes a motor and an output shaft as well as a first coupling for attaching the output shaft to the seat via a lost-motion connection allowing the output shaft to rotate through a selected angle before rotating the first coupling to raise the seat. A second coupling is provided for connecting the output shaft to the lid, wherein the second coupling has a clutch which disengages after the lid has been raised so that continued rotation of the drive shaft past a selected angle then raises the seat.

BRIEF DESCRIPTION OF THE DRAWINGS

FIG. 13C' being a continuation of FIG. 13 C;

DETAILED DESCRIPTION

Figure 1:
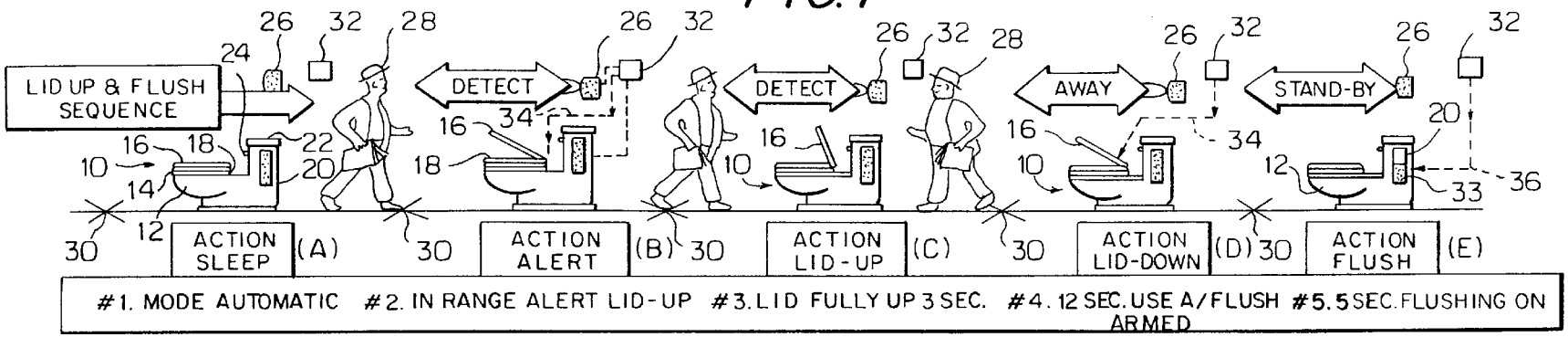
FIGS. 1A–1E is a schematic view pictorially illustrating operation of an automatic toilet lid raising and toilet flushing sequence in accordance with the present invention.

Referring now to FIG. 1, there is shown a toilet 10 which is comprised of a toilet bowl 12 having a toilet bowl rim 14 on which are pivoted a toilet lid 16 and a toilet seat 18. The toilet bowl 12 is connected to a flush tank 20 having a flush tank top 22 and a flush tank operating handle 24. In accordance with the present invention a sensor arrangement 26 is positioned adjacent to the toilet 10 to sense the presence of a person 28 at a location 30 in front of the toilet bowl 12. Preferably, the sensor arrangement 26 is an active infrared and radio frequency transmitting sensor which detects and activates by an RF signal a controller 32 which controls automatic raising and lowering of the lid 16 and seat 18, as well as an automatic flush system 33 for releasing flush water from the flush tank 20 by generating radio pulse codes 34 and 36, respectively. While radio frequency pulse links 34 and 36 are preferred, the links may also be hard wired.

As can been seen from the sequence, in FIG. 1A, the system is initially quiescent. In FIG. 1B, the person 28 when in a effective range of about 30 to 48 inches of the detector 26, as indicated by the location 30, causes the sensor arrangement 26 to actuate the controller 32 which raise the lid 16. Raising of the lid 16 preferably takes about 3 seconds. Once the lid 16 is up (FIG. 1C), it will remain up until the person 28 moves away from the toilet 10 as seen in FIG. 1D. As the person moves away from the toilet 10, sensor arrangement 26 activates the controller 32 to lower the lid 16. Preferably, after 12 seconds which indicates actual use of the toilet 10, the automatic flush is armed. As seen in FIG. 1E, automatic flush occurs after the lid 16 is down for about 5 seconds.

Referring now to FIGS. 2A–2D the system configured in accordance with the present invention does not interfere with conventional use of the toilet 10 and allows the person 28 to raise and lower the lid 16 by hand as well as to flush the tank 20 by using the handle 24. This is accomplished by having the lid feature switched on or off with a magnetic touch programming arrangement. The automatic flush will not cycle when manually flushed because manual flush is decoupled from the automatic flush, as is explained hereinafter with respect to FIGS. 7 and 8.

Figure 3:
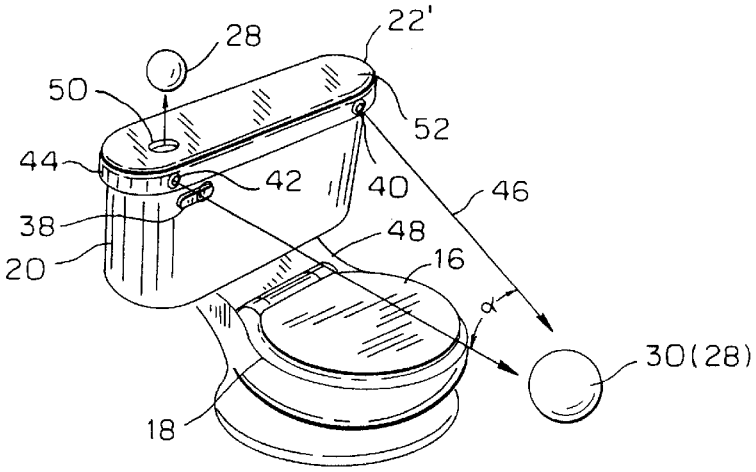
FIG. 3 is a perspective view of a toilet having a flush tank with a flush tank top having optical sensors placed thereon or therein for raising a lid in accordance with the principals of the present invention.
Figure 4:
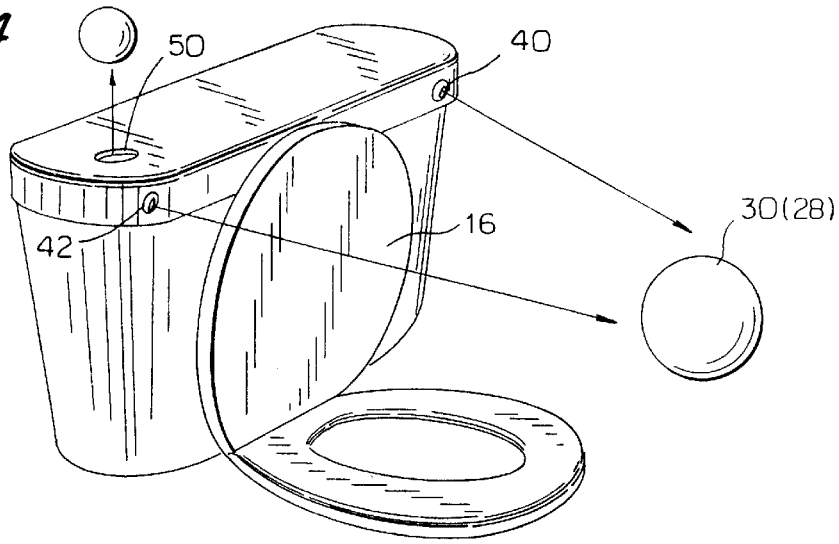
FIG. 4 is a perspective view similar to FIG. 3 but showing a raised lid with a toilet seat still down.
Figure 5:
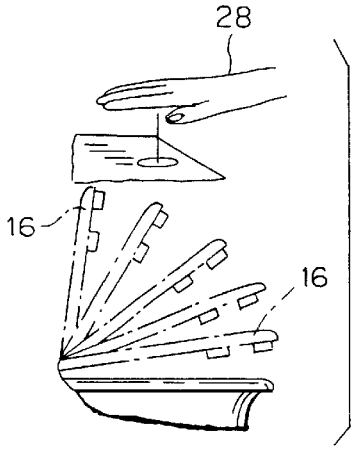
FIG. 5 is a perspective view showing touch free hand control of seat raising and/or toilet flushing operations.
Figure 6:
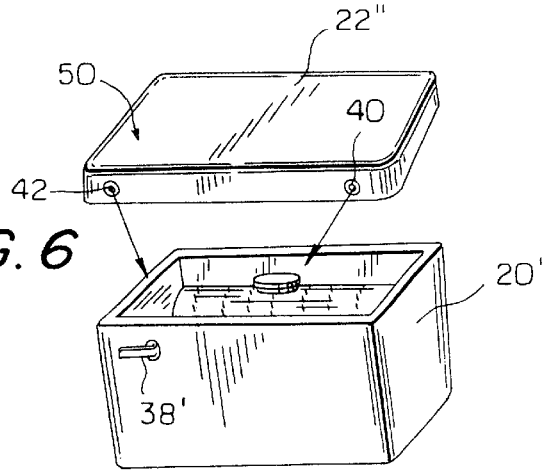
FIG. 6 is a perspective view of a toilet tank with a pressure assist flush having sensors on a tank top in accordance with the principles of the present invention.

Referring now to FIGS. 3–6 there is shown a preferred embodiment for the sensor arrangement 26 when the elements of a sensor arrangement 26' are mounted within a tank top 22'. As is seen in FIGS. 3, 4 and 6, the flush tank top 22' has a sensor arrangement 26' with first and second laterally directed optical sensors 40 and 42 which are preferably infrared sensors having radio frequency transmissions to operators for the seat 16, the lid 18 and the automatic tank flush system 33 (see FIGS. 1A–1F). The sensors 40 and 42 are in the illustrated embodiment mounted on the front rim 44 of the tank top 22 and have infrared sensing beams 46 and 48 that converge at an angle $\alpha$ toward a location 30' which is 30–48 inches in front of the toilet 10. The infrared beams or lines of focus 46 and 48 do not detect the presence of a person beyond the location 30' or the presence of a person to either side of the optical axes of beams 46 and 48. An infrared hand sensor 50 is positioned in the top surface 52 of the tank top 22' so that a person may activate the seat 16 or lid by holding their hand over the sensor 50 and/or may flush toilet 10 by holding their hand over the sensor 50, thus avoiding touching the lid 15, seat 16 or flush handle 24 (see FIG. 5). As seen in FIG. 6, the same optical sensing system is utilized for a pressure assist flush arrangement used in commercial and institutional toilets. With the flush top arrangement of FIGS. 3–6, toilets can be readily equipped to operate in accordance with the automatic sequence of FIGS. 1A–1E by just replacing conventional tank top 22 with the tank top 22' that is equipped with optical infrared sensors 40, 42 and 50 in accordance with the present invention.

Figure 2:
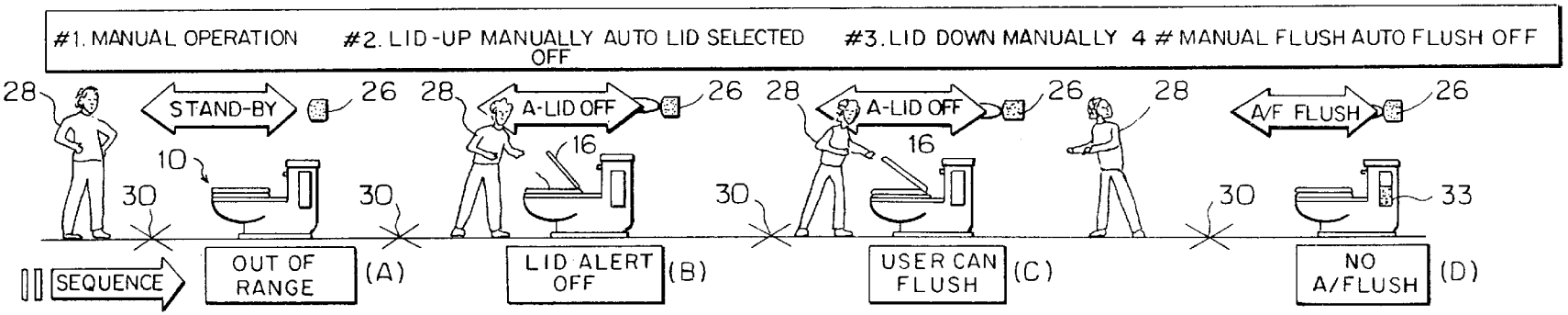
FIGS. 2A–2D is a view similar to FIG. 1, but showing manual operation when automatic operation has been interrupted FIG. 1.

Referring now to FIGS. 7 and 8A–8C there is shown a first embodiment of an automatic flush arrangement 60 which according to the principles of the present invention facilitates adaption of the system of FIGS. 1 and 2 for widespread use and is readily usable with the sensing arrangement of FIGS. 3–5 as well. The automatic flush actuator 60 is adapted to be readily mountable on an overflow tube 62 within a flush tank 20. Almost all flush tanks have an overflow tube 62, but to date, there are no fittable automatic flush actuators which mount readily on the overflow tube and allow for manual flush handle operation as well as automatic operation.

Figure 7:
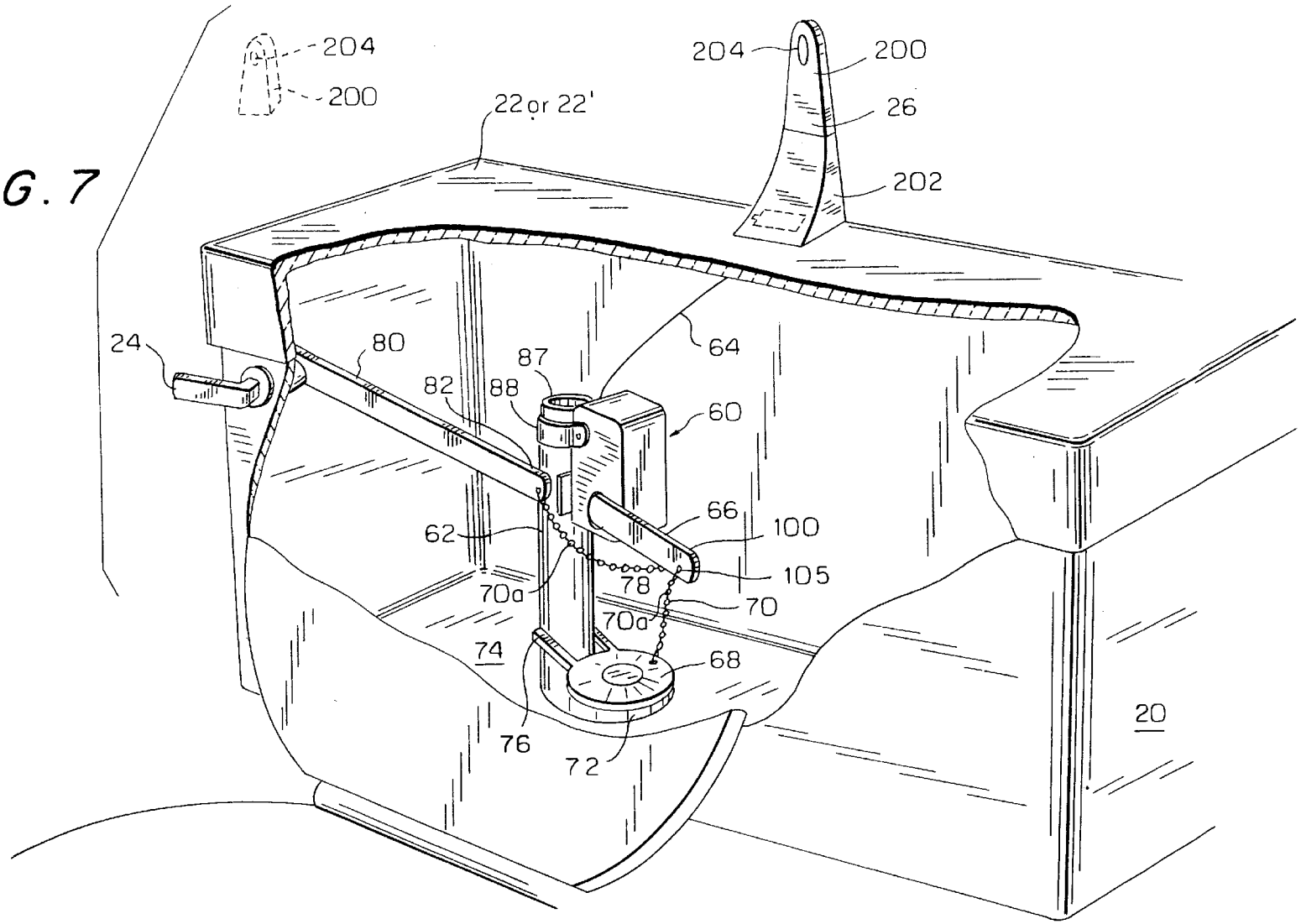
FIG. 7 is a perspective view of a first embodiment of automatic flush actuator mounted on a overflow tube within a flush tank in accordance with the principles of the present invention.

Referring now mainly to FIG. 7, it is seen that the tank top may be a tank top 22 with a separate sensor arrangement 26 (also see FIGS. 15–18) or a tank top 22' with the sensor arrangements of FIGS. 3–5, wherein the sensors are integral with the tank top. For purposes of discussion with respect to the automatic flush arrangement flush 60, the sensor arrangement 26 is shown connected to the automatic flush arrangmement by hard wiring i.e. by a line 64. The sensor arrangement 26 also contains batteries so as to provide electric current to operate a motor within a housing attached to the overflow pipe 62, as further explained hereinafter.

As is seen in FIG. 7, the automatic flush arrangement 60 is connected by an operator 66 to a flapper valve 68 by a flexible member such as a chain 70 which preferably has slack which must be taken up before the flapper valve 68 can be moved by the operator 66. When in a first mode the operator 66 allows the valve 68 to remain closed and when in a second mode to operator 66 opens the valve. While the chain 70 is preferred, other couplings between the operator 66 and the valve 68 can be utilized, such as but not limited to, articulated links or perhaps even rigid links. Flapper valve 68 plugs a flush outlet hole 72 through the floor 74 of the flush tank 22. While the valve 68 in the illustrated embodiment is pivoted by pivot points 76 to the overflow tube 62, the valve 68 may however be otherwise mounted to pivot or move so as to open and close the flush tank outlet 72. When the operator 66 moves upwardly, the chain 70 tensions and then lifts the valve 68 in order to release water from the tank 20 in order to flush the toilet bowl 12. Operator 66 is connected by a portion 78 of the chain 70 to a manual flush lever 80 which has a substantially fixed connection to the flush handle 24 so that when the flush handle 24 is depressed, or rotated counter clockwise in FIG. 7, distal end 82 of the manual flush level 80 rises and tensions the portion 78 of the chain 80. Tensioned portion 78 of the chain 70 then lifts the operator 66 which tensions the chain 70 to raise the valve 68 and thus manually flush toilet bowl 12. This is possible because the operator 66 is coupled to a driver in the form of a driving motor by a lost motion connection which enables the operator 66 to bypass the driver and to rise independently of the drive motor, as will be explained hereinafter.

Figure 8A:
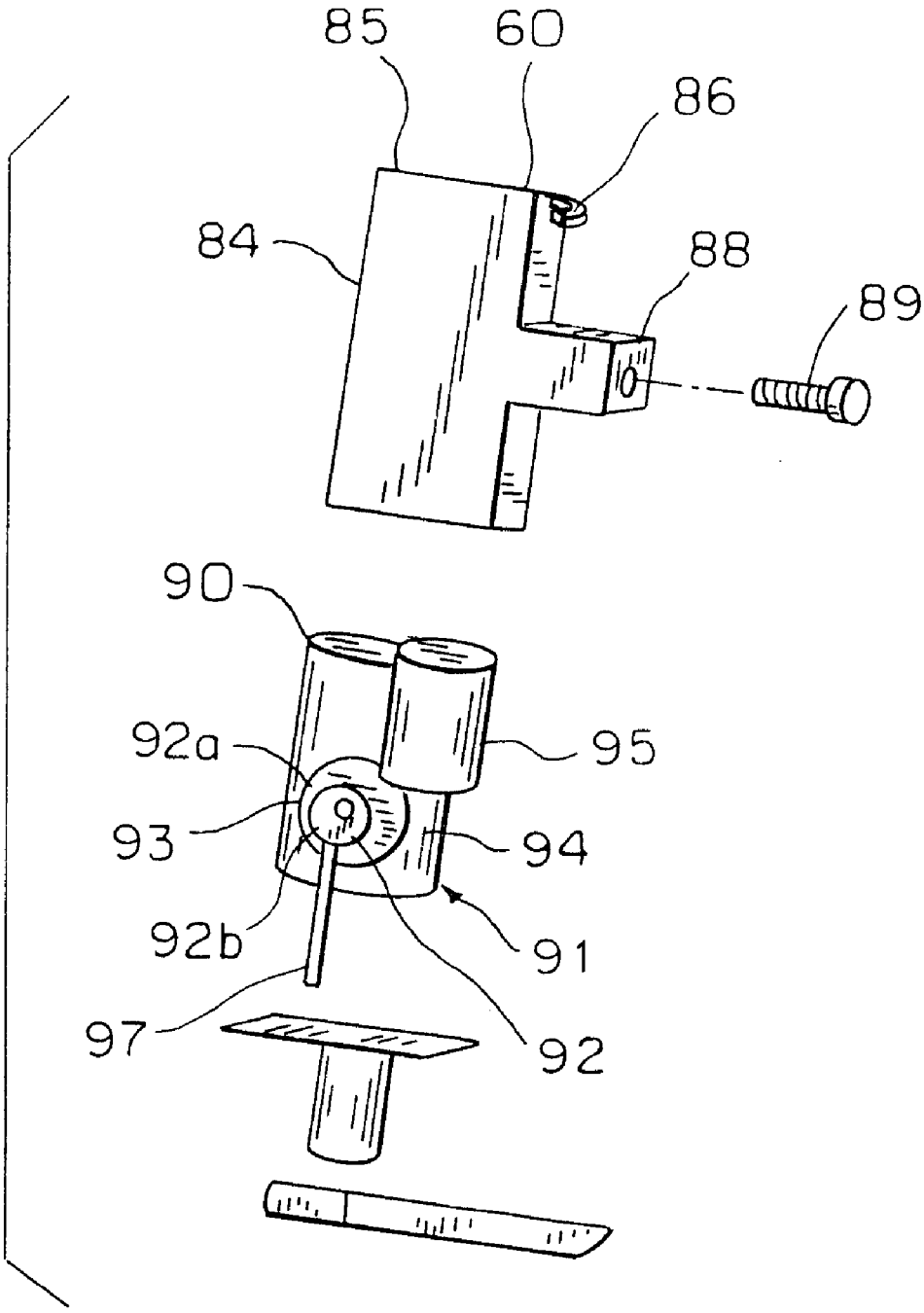
FIG. 8A is an exploded perspective view showing the components of the flush tank actuator of FIG. 7.
Figure 8B:
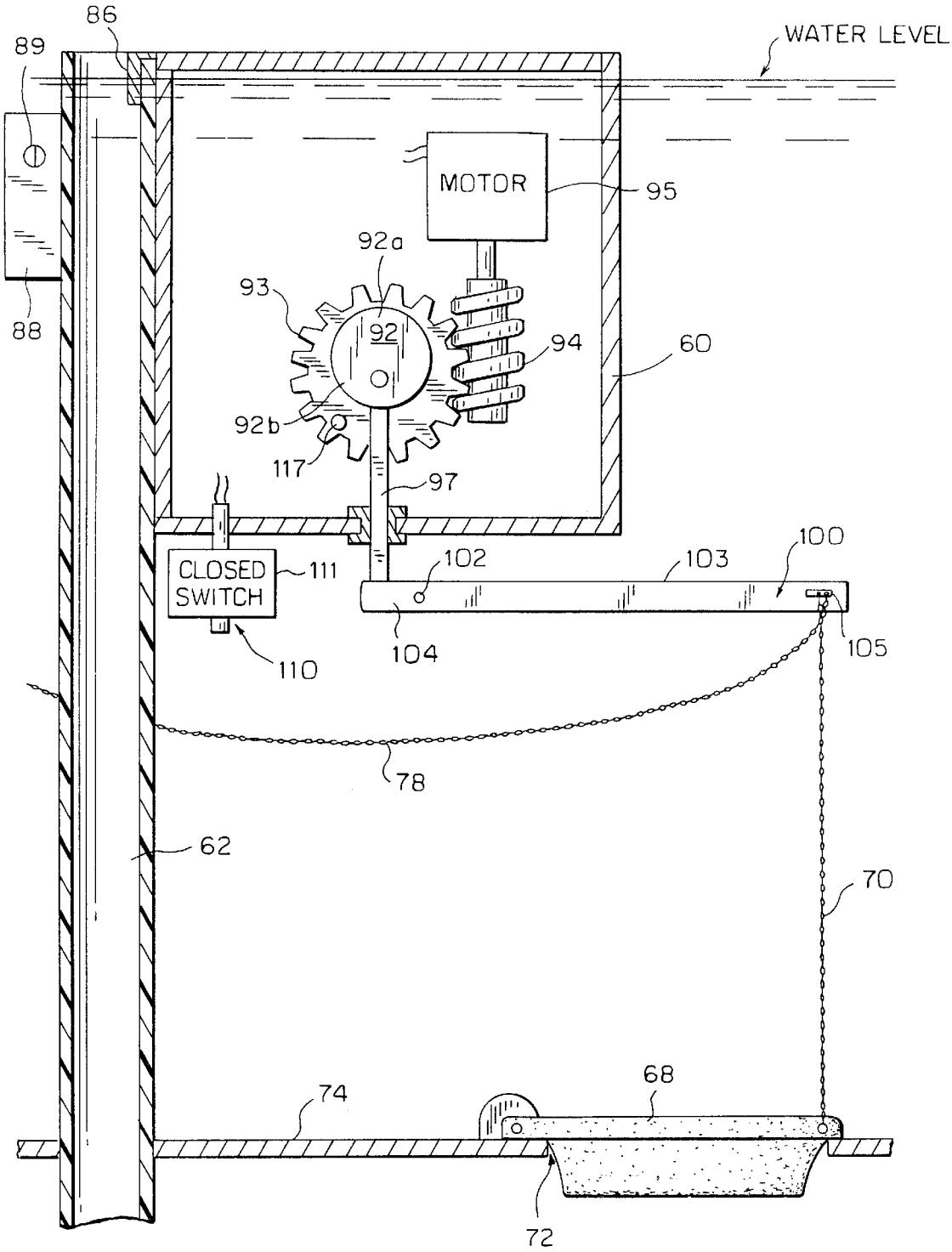
FIG. 8B is a side view showing the components of FIG. 8 assembled with the flush tank full.
Figure 8C:
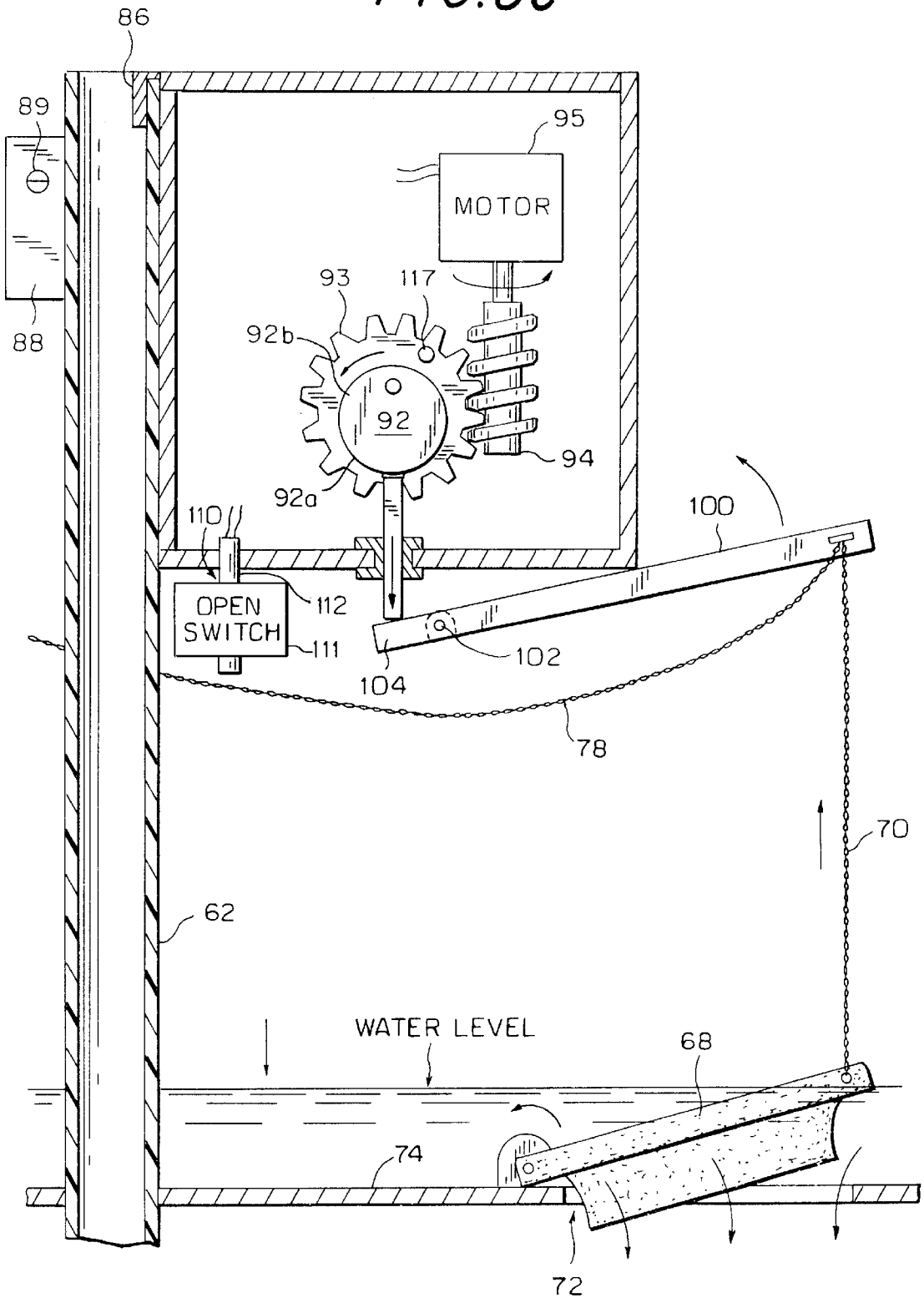
FIG. 8C is a side view similar to FIG. 8A but showing the flush tank being emptied of water.
Figure 8D:
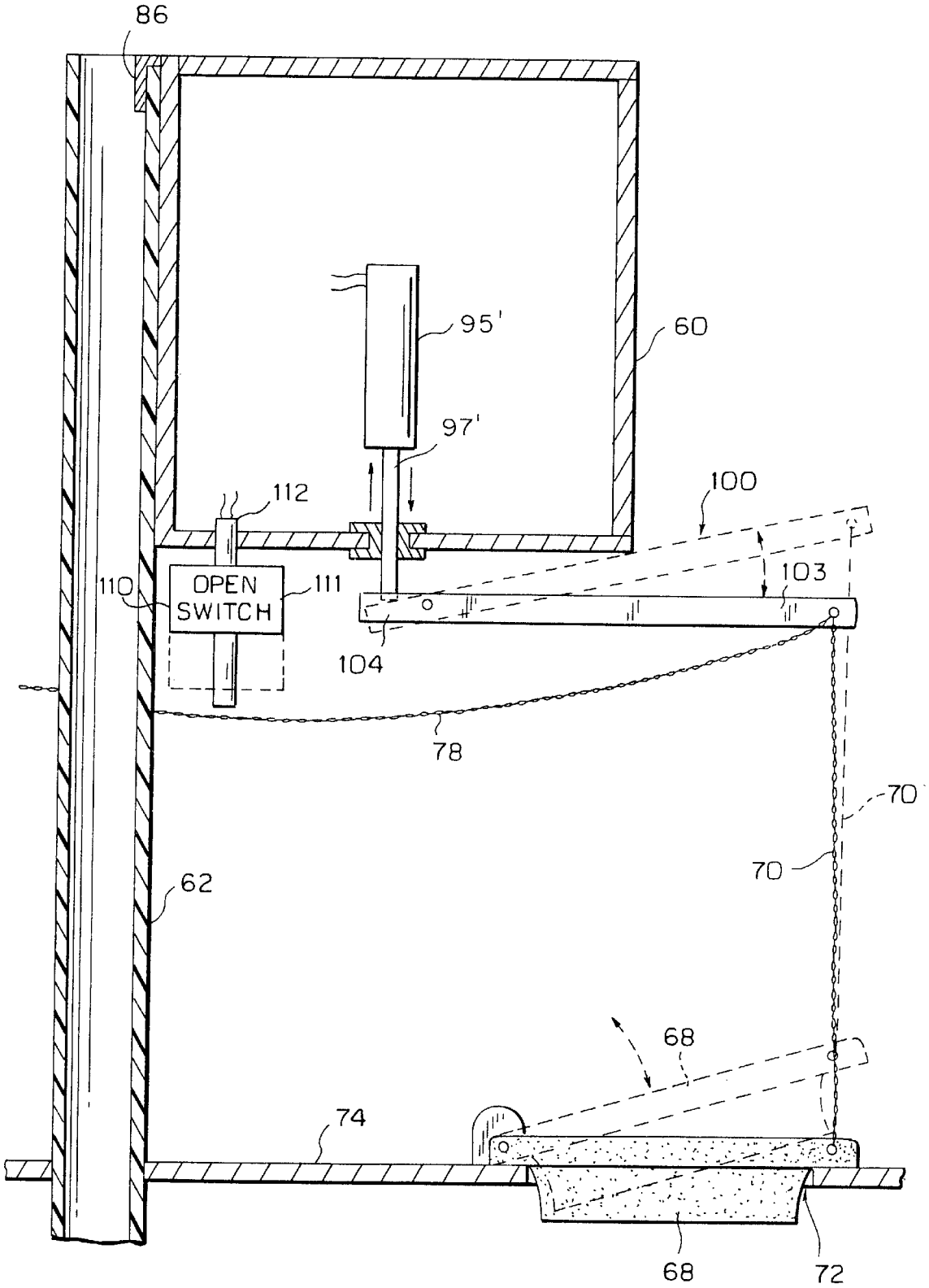
FIG. 8D is a side view of an alternative embodiment of the invention wherein a linear actuator, such as a solenoid, is used to flush a toilet.

As seen in the exploded view of FIG. 8A and the operational views of FIGS. 8B and 8C, the automatic flush actuator 60 is comprised of housing 84 is configured as a molded water proof cup having a top end 85 with a projecting hook 86 that fits into the open top 87 of the overflow pipe 62. The housing 84 has a pair of laterally extending straps 88 which fit around overflow tube 62 and fasten the housing 84 tightly to the overflow tube when a bolt 89 fastens the straps together.

Figure 12:
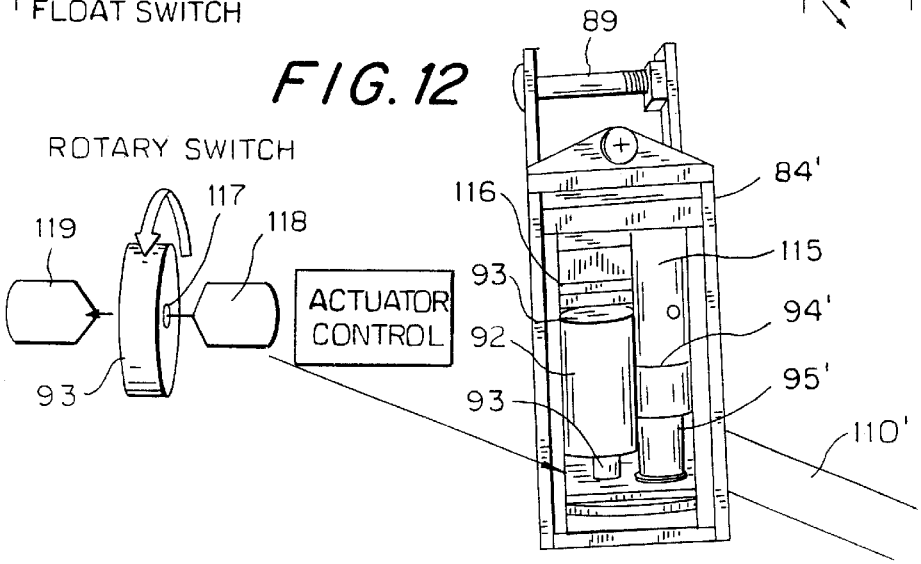
FIG. 12 is a top view of the components of the flush actuator of FIG. 9 shown assembled in a housing with the top of the housing removed.

In the housing 84, there is positioned a printed circuit board 90 with an optical switch 91 (see FIG. 12). The optical switch 91 detects the position of a unidirectional cam 92 mounted on a gear 93 driven by a worm gear output 94 of an electrical motor 95. When the motor 95 receives a signal from the controller 32 (see FIG. 1) associated with the sensor arrangement 26 (see FIG. 1), the motor rotates the gear 93 about one revolution, which revolution is detected by the optical switch 91 that interrupts current to the motor 95 upon detecting one revolution of the gear. Electric current to power the motor 95 is supplied over line 64 from batteries in the housing of the sensor arrangements 26 (see FIG. 7).

As is seen in FIGS. 8B and 8C, during the one revolution of the gear 93 a cam follower 97 is pushed down by the cam 92 and drives the operator 66. In the preferred embodiment of the invention, the operator 66 is a lever 100 pivoted at a pivot point 102 that divides the lever into a long portion 103 and a short portion 104. Cam follower 97 rests against the short portion 104 of the lever 100. As the cam 92 is rotated by the gear 93 so that the cam's major lobe **92*a* moves into engagement with the top of the follower 87, the follower is pushed down which lifts the long portion 103 of the lever 100. Since the long portion 103 of the operating lever 100 weighs more than the short portion 104, the lever 100 is normally in an at rest position in which it is rotated clockwise and presses upwardly against the cam follower 97**.

When in the normal position, the flush lever 80 (See FIG. 7) can lift the operating lever 100 independently of the motor 95, gear 93 and cam 92 because the short portion 104 of the operating lever simply drops away form the cam follower 97 as lever 100 rotates counterclockwise while being pulled by chain portion 78 attached to the flush lever 80. Dropping away of the cam follower 97 from the cam 92 provides a first lost-motion connection between the cam 92 and cam follower 97, which lost-motion connection decouples the cam follower 97 from the cam 92. Alternatively, the cam follower 97 may drop away from the minor lobe **92*b* of the cam 92 when the chain 78 is pulled creating a bypass or a second lost motion relationship. The preferable chain 70 is comprised of stop elements such as balls 70*a* which are received in a slot 105 in the end of the long portion 103 of lever 100**.

A base 106 provides a vapor barrier to seal an opening 107 through which the cam follower 97 slides to engage the minor portion 104 of the lever 100. In addition, the base has a clevis 107 to receive a pin 108 that provides a pivot for the lever 100 which comprises operator 66. As the operating lever 100 rises, it moves toward the end of the flush operating lever 80 and simply creates more slack in the chain portion 78. Accordingly, the chain portion 78 provides a second lost-motion connection, which second lost-motion connection is disposed between flush lever 80 the operating lever 100.

The particular arrangement shown in FIGS. 7 and 8 is an initial or first embodiment of the invention.

Figure 9:
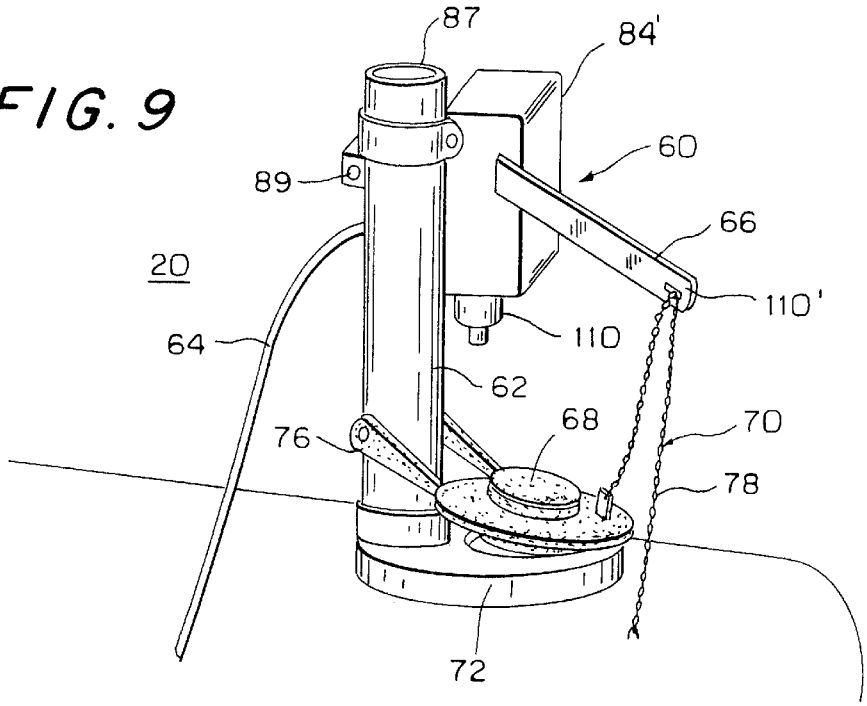
FIG. 9 is a perspective view of another embodiment of an automatic flush actuator in accordance with the principles of the present invention.
Figure 10:
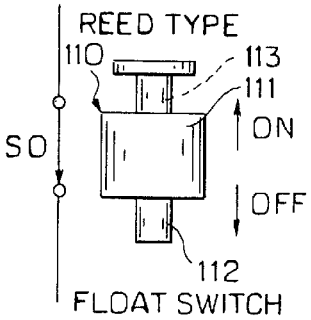
FIG. 10 is a side view of a float switch used with the flush actuator of FIG. 9.

A second and preferred embodiment of the invention is shown in FIGS. 9–12. In FIG. 9 a float switch 110 projects from housing 84'. As is seen in FIG. 10, the float switch 110 comprises a float 111 having a magnet sealed therein, the float being mounted on a hollow shaft 112 having a reed switch 113 (preferably a SPST 10 Va switch) therein which opens when the float is down, but allows the motor 95' to continue running until current is interrupted. The reed switch 113 closes when the float 111 is up connecting the motor 95' to its source of power (preferably D-batteries in the housing of the sensor arrangement 26) so that when the sensor arrangement 26 again detects toilet use, a switch is closed energizing the motor.

Figure 11:
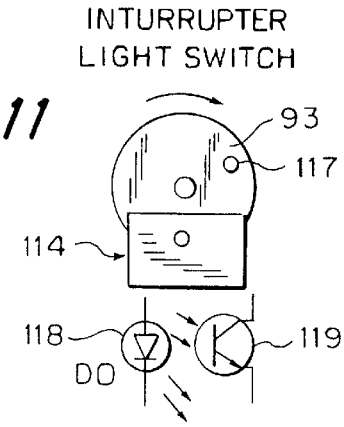
FIG. 11 is a side schematic view showing an optical switch used with the flush actuator of both FIGS. 9–11 and FIGS. 7 and 8.

FIG. 11 is a schematic view of an automatic optical switch 114 which stops rotation of the gear 93 which mounts cam 92 after one revolution. The gear 93 has an aperture 117 therethrough which allows passage of light from an LED 118 to a detector transistor 119. When the detector 119 receives light from the LED 118, power to the motor 95' is interrupted by opening a switch 119' and rotation of the worn gear output 94 stops with the cam follower 97 in its retracted mode (FIG. 8C) against the small lobe 92*a* of the cam 92. For a subsequent flush cycle, the aperture 117 is aligned with the LED 118 so that control circuit logic again allows energizing of the motor 95'.

Referring now to FIG. 12, which is a top view of the preferred embodiment, it is seen that the motor 95' drives an intermediate gear 115 with the worm gear drive 94'. The intermediate gear 115 has a mounting shaft 116 in the form of a gear with teeth that mesh with the teeth of gear 93 which mounts the unidirectional cam 92. By having an intermediate gear 115 increased torque is available to push the cam follower 97. The cam 92 is connected to the operating lever 100' via the cam follower 97 with a lost motion connection in the manner shown in FIGS. 8A–8C.

Figure 13A:
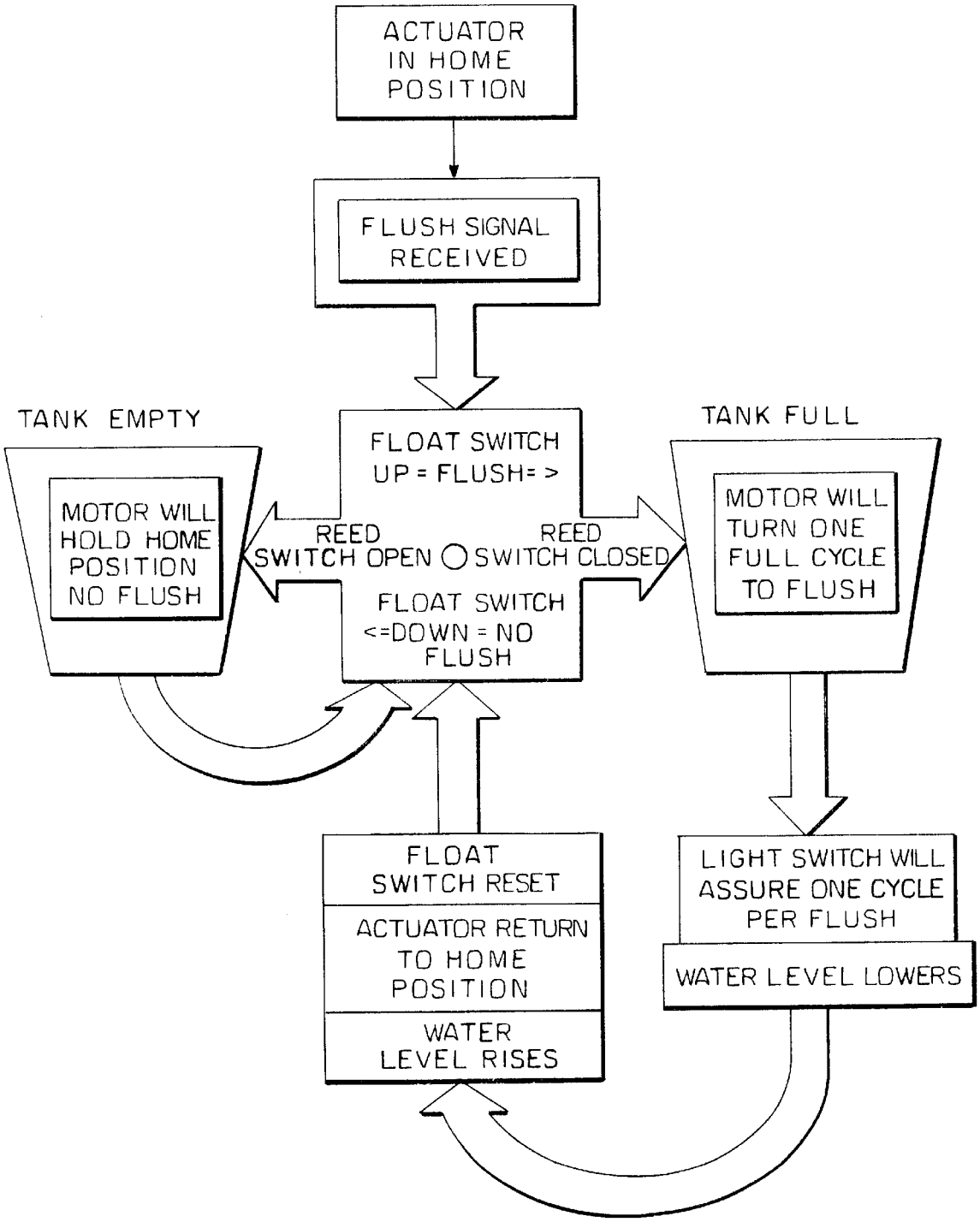
FIG. 13A is a block diagram of a control circuit utilizable to accomplish operation of the present invention.

Referring now to FIG. 13A, the block diagram shows cooperation between the float switch 110, the optical switch 114, the sensor/transmitter (200, FIGS. 15–19) and the motor 95', wherein the motor holds the home position of FIG. 8C when the float 111 (FIG. 10) is down and can not respond to a signal from the sensor/transmitter until the flush tank is full and the float 111 is up. The motor 95' then rotates the cam 92 through one full cycle to flush the toilet. At one full cycle the light switch activates to stop rotation of the motor 95'. After the tank refills raising the float 111, the motor is enabled to again rotate the cam 92 for the next automatic flush when initiated by the sensor/transmitter 200.

As is seen in FIG. 13 B, the output on lines 130 and 131 are both low when the float switch 110 and optical switch 114 are closed. This enables the motor 95' to rotate when connected by an operating switch to the C batteries in the receiver battery pack 202 (FIGS. 15-19).

Figure 13B:
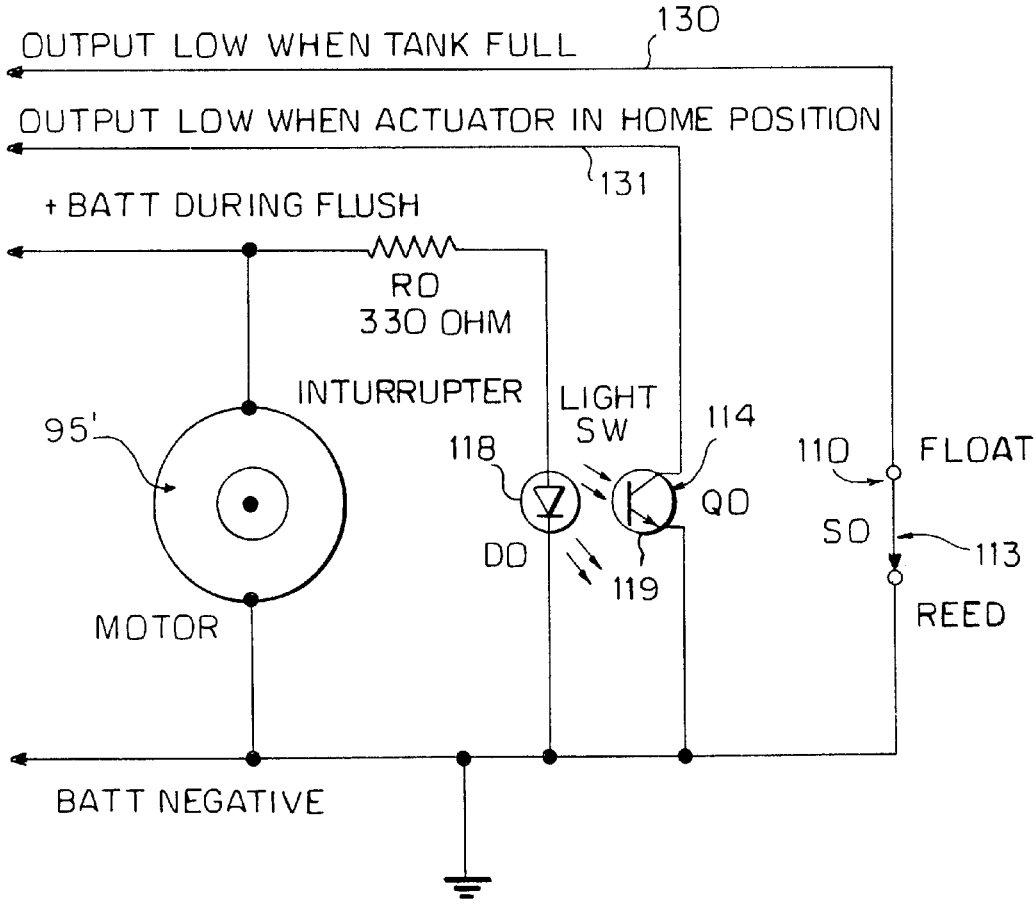
FIG. 13B is a circuit diagram showing how the float switch of FIG. 10 and optical switch of FIG. 11 are used to control a motor in accordance with the block diagram of FIG. 13A.
Figure 13C:
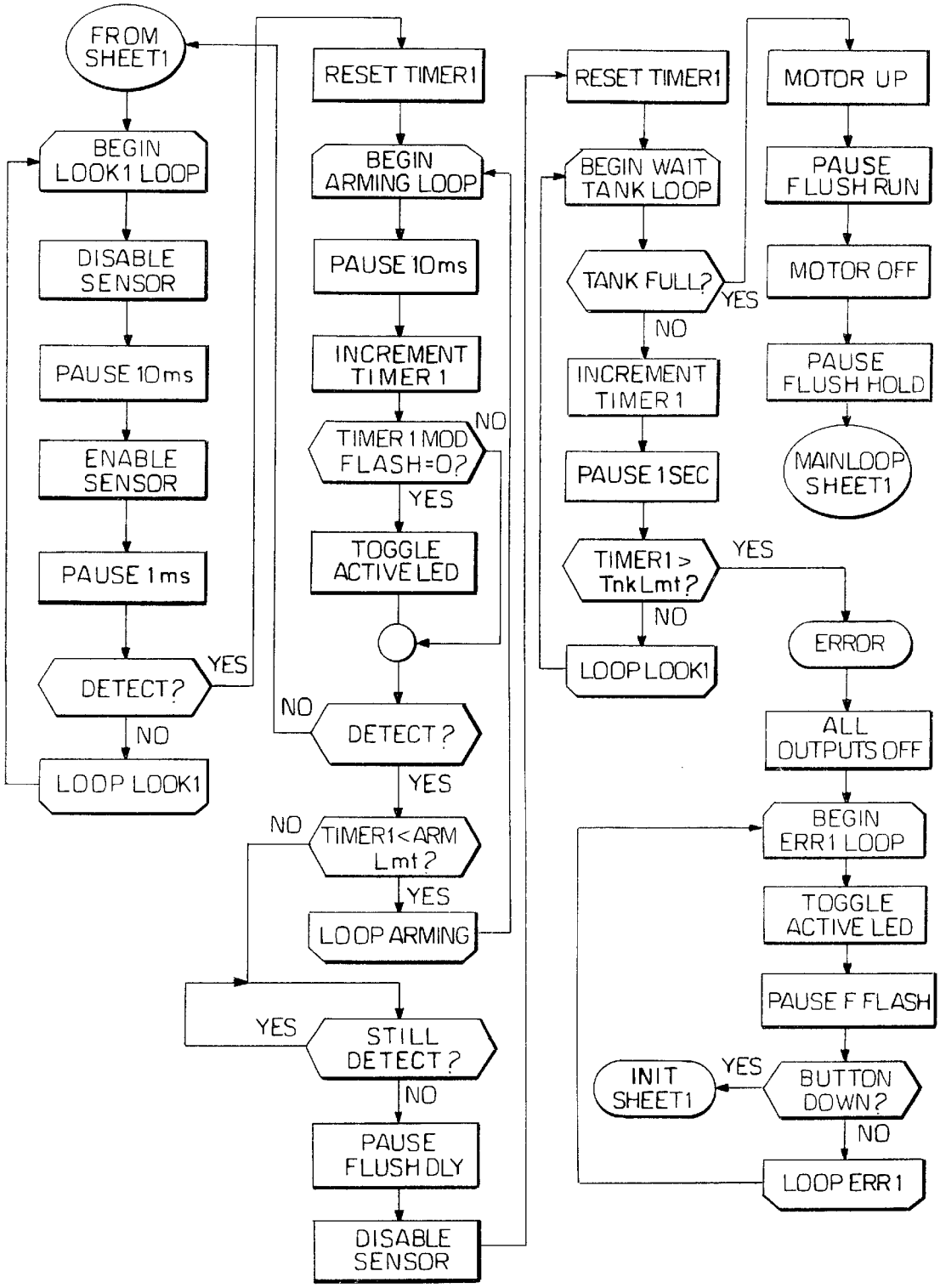
FIGS. 13C and 13C' are a flow chart of programming for a microchip used in controlling the motor.

Referring now to FIG. 13C control software for the system comprises a single source module system written for the PICBASIC I interpreter provided by Parallax, Inc. The system includes a Microchip PIC16C56 programmed with the PICBASIC interpreter.

The control software executes a series of conditional statements that transfer control consecutively form motor control initiations (stop, up, down) to timing operations (pause m milliseconds) to polling operations (check person sensor, pushbutton, and motor current) in a sequence as follows:

1. Initialize ports, variables
2. Move motor to home, allowing up to a certain max time
3. If pushbutton is down, calibrate pre-position by moving motor up until it is released
4. Move motor up to pre-position by timing up motion per calibration
5. Continually check sensor and pushbutton:
   If pushbutton is pressed, go to 2
   If sensor detects body of person using the toilet for 3 seconds go to 6
6. Wait for person to leave (sensor non-detect for 1 second)
7. Check float switch, if tank is not full, wait for fill up to a certain max time
8. Move motor up to flush and wait there briefly
9. Go to 2

Figure 13D:
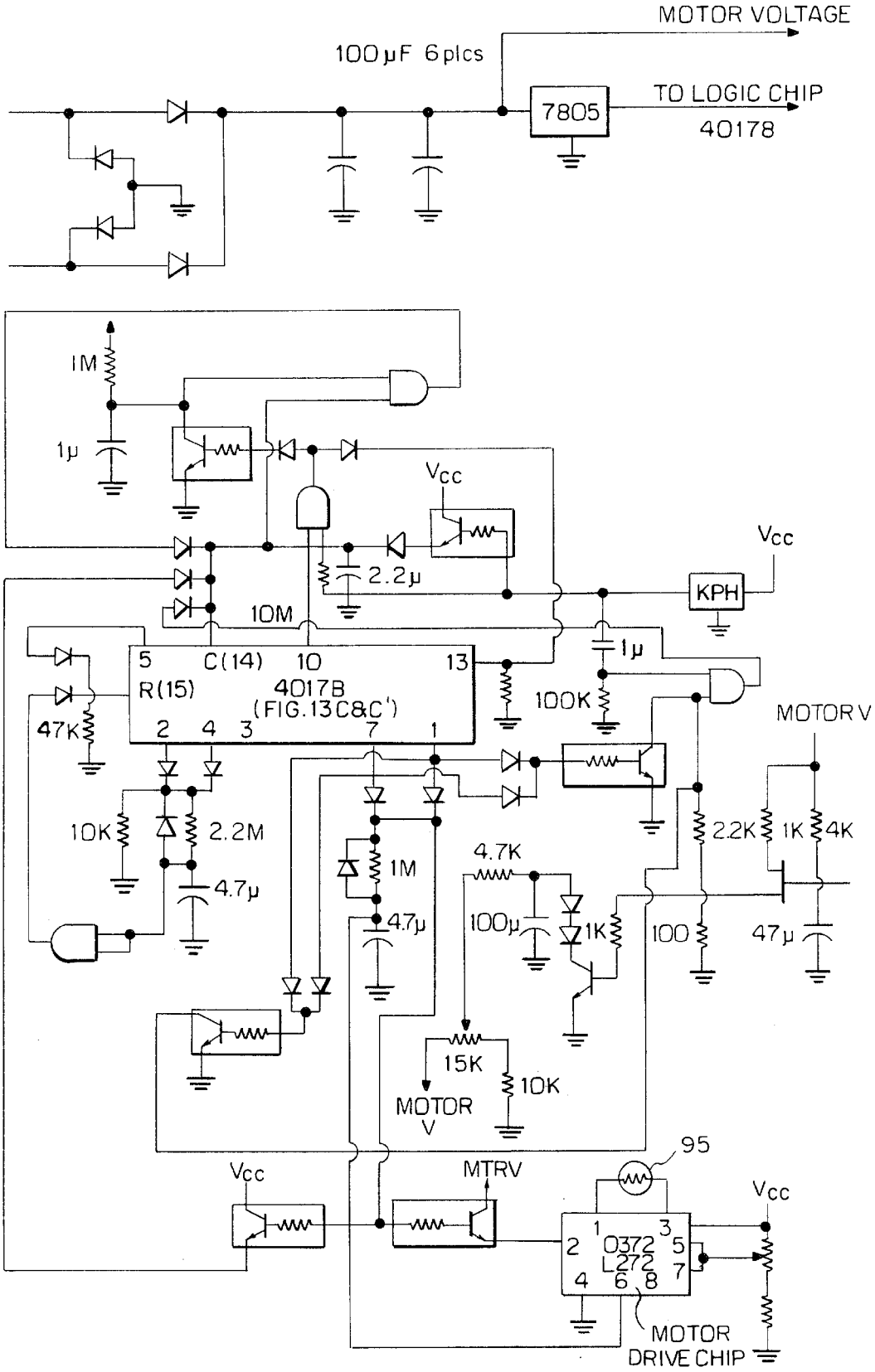
FIG. 13D is a circuit diagram for operating the automatic flush system of FIGS. 7–13C.

FIG. 13D is a circuit diagram of a circuit for practicing the present invention to drive the motor 95 in accordance with the block diagram of FIG. 13A, circuit of FIG. 13B and Flow Chart of FIG. 13C.

Other embodiments of the invention could include a linear motor or solenoid (95', FIG. 8D) rather than the rotational motor 95 to rotate the lever 100. Another approach could use an electromagnetic actuator to attract the minor portion 104 of the lever 100. In still another embodiment, a solenoid could be connected directly to the valve 68 and be connected by a lost-motion connection to the flush operating handle 80.

Figure 14:
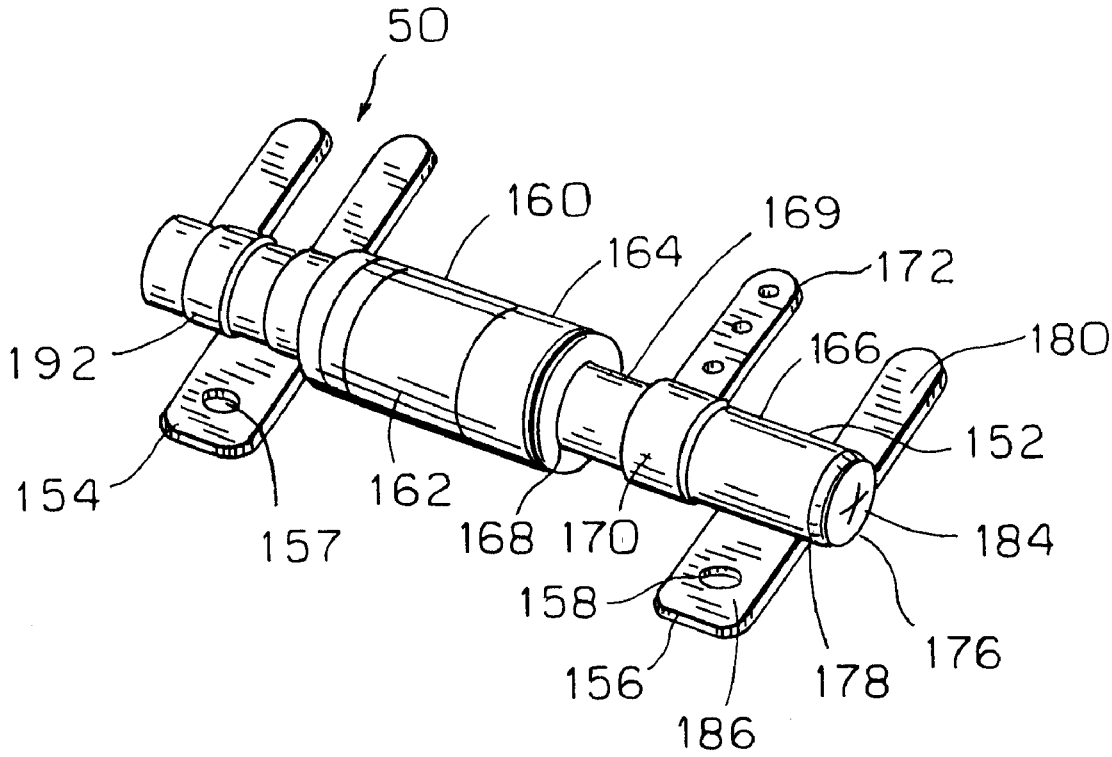
FIG. 14 is a perspective view of a device for raising and lowering a toilet lid and toilet seat without touching the toilet seat and lid.
Figure 16:
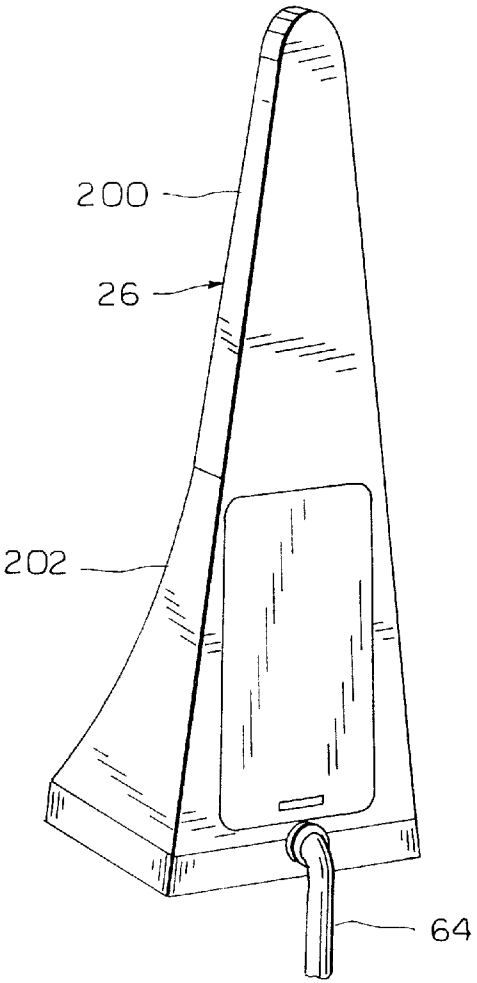
FIG. 16 is a rear perspective view of the sensor arrangement of FIG. 15.
Figure 15:
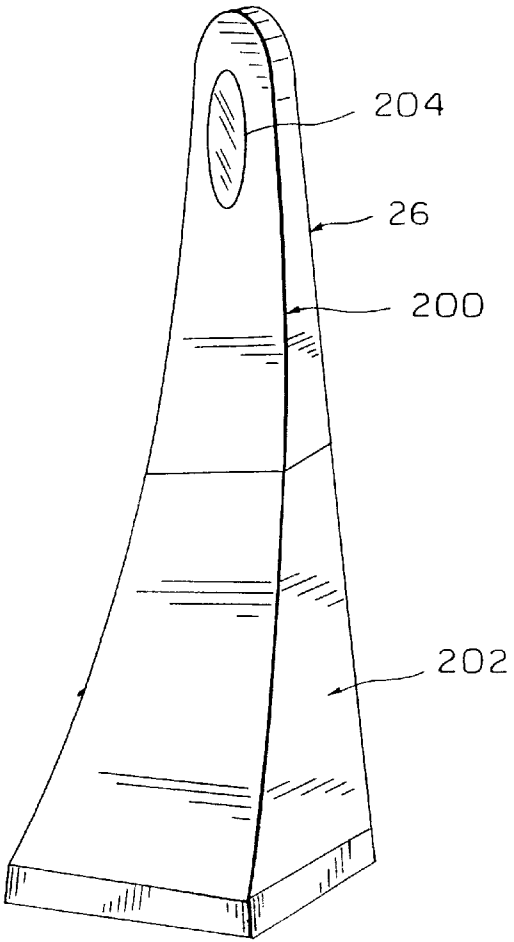
FIG. 15 is a front perspective view of the sensor arrangement which includes a battery power pack.
Figure 19:
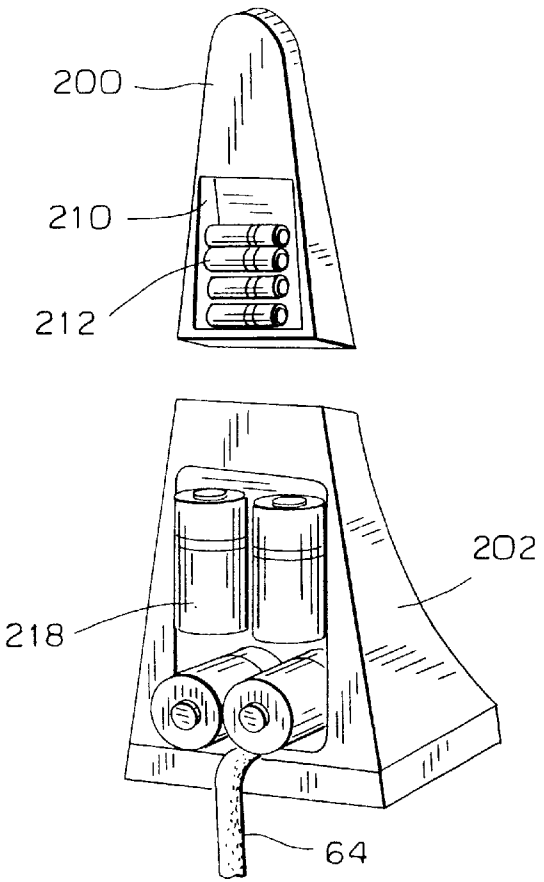
FIG. 19 is a rear view of the sensor arrangement showing battery packs therein.
Figure 18:
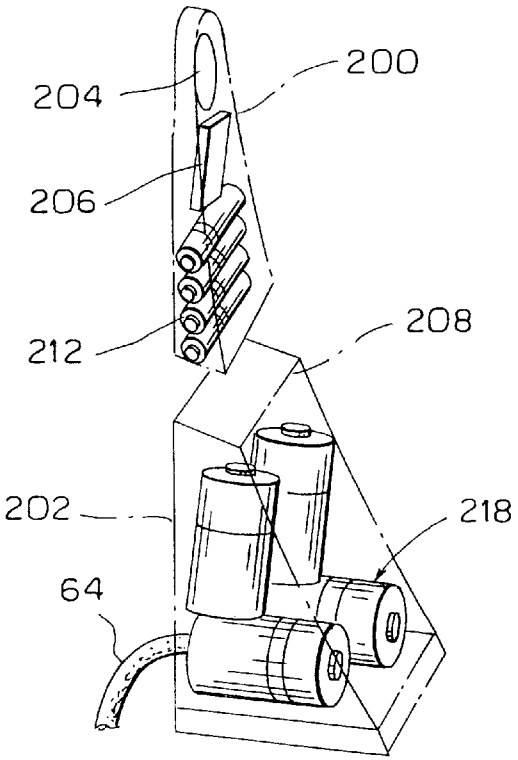
FIG. 18 is a side perspective view showing components within the sensor arrangement of FIGS. 15 and 16.
Figure 17:
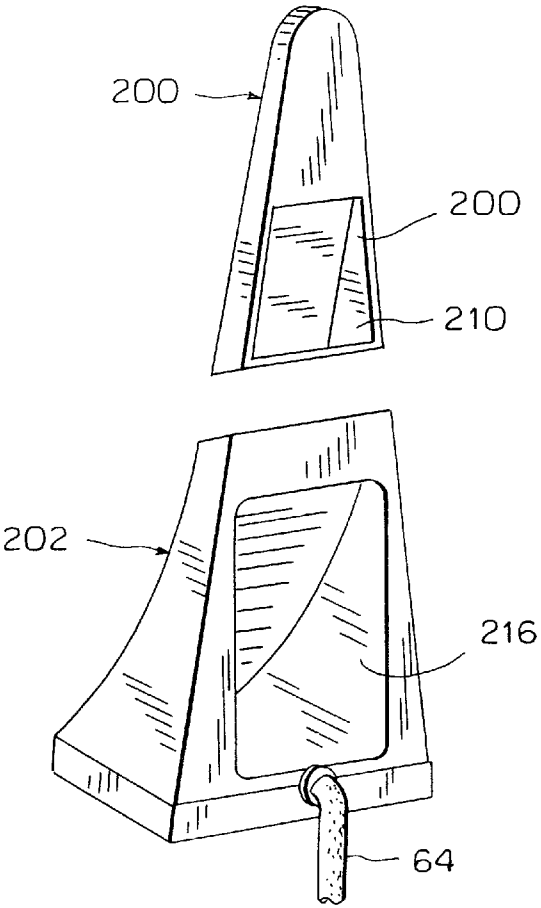
FIG. 17 is a rear perspective view of the sensor arrangement of FIGS. 15 and 16 but showing covers removed from battery pack chambers.

Referring now to FIG. 14, there is shown operator 150 for both the lid 16 and seat 18 of FIGS. 1 and 2. Seat and lid operator 150 has a base 152 that has straps 154 and 156 with holes 157 and 158 through which the bolts which mount the seat and lid of the toilet bowl rim are received. A housing 160 is mounted on the base, the housing 160 including a motor 162 and a reduction gear assembly 164. The reduction gear assembly 164 drives output shaft 166 which has thereon a first cam 168 and a second cam 169. Cam 168 is directly connected to the output shaft 166 as to rotate therewith while the cam 169 drives hub 170 that is rigidly attached to a strap 172. The strap 172 is rigidly connected to the lid 18 (FIGS. 1 and 2) so that the lid 18 can be pivoted by the strap when the driven hub 170 is rotated. Rotation of the driven hub 170 therefore lifts the lid 18 from its closed position to its open position. At one end of the output shaft 166, there is a lost-motion connection 176 between the output shaft 166 and a hub 178 that has a strap 180 rigidly fixed thereto. Strap 180 is bolted to the seat 16 so that rotation of the strap 180 will lift the seat 18 from its down position to its up position. The lost motion connection 186 comprises a pair of lugs 184 and 186 disposed around the end of the shaft 166 which are engaged by a radially projecting pin 188 in the end of the shaft when the shaft rotates through a selected angle θ.

The selected angle θ allows the shaft 136 to rotate sufficiently as to only raise the lid 16 by rotating the strap 172. After the strap 172 has raised the lid 16 due to the spring biased coupling between the spring loaded drive cams 168 and 169, and after the lid is stopped from rotation by engaging the toilet tank 22, the cams 168 and 169 act against the spring bias urging them together. This is because the cam 168 can no longer rotate the cam 169 and therefore pushes the cam 169 axially toward the hub 170, decoupling cam 168 from cam 169. After the cams 169 and 168 are decoupled, the pin 188 on the end of the shaft 166 engages lugs 184 and 186 the strap 180 and pivots the strap 180 from its down position to its raised position so as to pivot the toilet seat 16 (FIGS. 1 and 2) its up position.

At the opposite end of the drive shaft 166, there is a support shaft 192. Support shaft 192 includes dual torsion springs which provide for counter balance forces that allow the motor 132 to lift both the lid 16 and the seat 18 with minimal effort. Torsion springs also allow for lowering the seat 18 and then the lid 16 relatively slowly as the input shaft 166 of the motor rotates in the opposite direction, i.e. the clockwise direction with respect to FIG. 14.

The motor 132 is controlled either to lift the lid 16 as is the case with FIG. 1 or to lift both the lid 16 and the seat 18. In a woman's bathroom, the seat 18 is not lifted for use, whereas in a men's bathroom, the seat 18 as well as the lid 16 needs to be lifted. This is accomplished by the discretion of the user by hand signals to the sensor 50 of the tank top 22' (see FIGS. 3–5) which instructs the motor 162 to rotate through a further rotation to lift the seat 18 as well as the lid 16.

Referring now to FIGS. 15–19 wherein the sensor arrangement 26 is shown in detail it is seen that the sensor arrangement comprises a remote sensor/transmitter 200 and a receiver/battery pack 202. The sensor/transmitter 200 is detachable from the receiver/battery pack 202 for positioning in a different location such as for example on a wall instead of on a tank top. It contains a sensor 204, such as for example an optical or infrared sensor and a transmitter 206 for transmitting an rF signal to a receiver 208 receiver/battery pack 202. Optionally the transmitter 206 may be hard wired to the receiver 208. The remote sensor/transmitter 200 includes a chamber 210 for batteries 212, which are for example four AA batteries.

The receiver/battery pack 202 includes the circuit board 208 and a chamber 216 for receiving batteries 218, which are for example four C batteries. The receiver circuit board 208 closes a switch which causes current to flow down line 64 to power the motor 95 to rotate the gear 93 and cam 92 one revolution.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An automatic flush actuator adapted to be mounted on an existing overflow pipe in a flush tank of a toilet, wherein the tank includes an outlet normally closed by a valve and a manual flush device for opening the valve, the automatic flush actuator comprising:

an operator adapted to be mounted on the existing overflow pipe and adapted to be coupled to the valve for allowing the valve to remain closed when in a first mode and for opening the valve when in a second mode the operator comprising a lever pivoted adjacent to the overflow pipe and connected to both the manual flush device and valve by a flexible member;

a driver coupled with the operator for causing the operator to move form the first mode to the second mode, and a bypass connection adapted to couple the operator to the manual flush device while bypassing the driver for shifting the operator from the first mode to the second mode manually.

2. The automatic flush actuator of claim 1 wherein the flexible member is comprised of a plurality of stop elements whereby lengths of the flexible member between the lever and valve and between the lever and manual flush device are adjustable.

3. The automatic flush actuator of claim 1 wherein the driver comprises a rod which engages one end to the lever to pivot the lever from the first mode to the second mode.

4. The automatic flush actuator of claim 3 wherein the rod is a cam follower advanced by a rotary cam, the cam being drives by an electric motor powered by batteries.

5. The automatic flush actuator of claim 3 wherein the rod is driven by a linear actuator.

6. The automatic flush actuator of claim 5 wherein the linear actuator is an electrically powered solenoid.

7. The automatic flush actuator of claim 1 further including a coupling for mounting the operator on the overflow pipe.

8. The automatic flush actuator of claim 7 wherein the coupling is attached to a housing mounting the operator and wherein the coupling fits around the existing overflow pipe.

9. The automatic flush actuator of claim 1 wherein the motor is coupled to the operator through a gear which drives a cam that urges a plunger against the lever.

10. An automatic flush actuator adapted to be mounted on an overflow pipe in a flush tank of a toilet which is original equipment or an existing installation, wherein the tank includes an outlet normally closed by a flapper valve, the automatic flush actuator comprising:

a housing having a coupling for mounting the housing on the overflow pipe;

an operator mounted on the housing and adapted to be coupled to the valve with a first flexible member for allowing the flapper valve to remain closed when in a first mode and for opening the flapper valve when in a second mode;

a motor mounted with the housing and coupled to the operator through a cam connected to a plunger by a first lost-motion connection for causing the operator to cycle from the first mode to the second mode and back to the first mode, and a second lost-motion connection coupling the operator to the manual flush device for shifting the operator from the first mode to the second mode manually without energizing the motor.

11. An automatic flush actuator according to claim 10 wherein the first lost-motion connection comprises:

a cam driven by the motor to cycle through two positions corresponding to the first and second modes of the operator, wherein the first lost-motion connection further includes a coupling between the cam and operator, the coupling having a positive connection with the operator when the cam is cycling through the two positions and being decoupled from the cam when the operator is in the first mode.

12. An automatic flush actuator according to claim 11 wherein the coupling of the first lost-motion connection is a cam follower which rests on the operator and always allows the operator to move from the first mode to the second mode when pressing the manual flush device.

13. An automatic flush actuator according to claim 12 wherein the operator is a lever pivoted on the housing and having a bias toward the first mode.

14. An automatic flush actuator according to claim 10 further including a power source connected to the motor by a power line wherein the power source is adapted to be positioned outside of the flush tank.

15. The automatic flush actuator of claim 14 further including a sensor arrangement for sensing the presence of a person in proximity with the toilet to set an activator circuit which includes a tripper circuit connected to the power supply to deliver electric current to the motor when the person moves away from the toilet so as to cause the toilet to flush by energizing the motor.

16. The automatic flush actuator of claim 10 wherein the coupling fits around the overflow tube to mount the housing on the existing overflow pipe.

17. The automatic flush actuator of claim 10 wherein the first flexible member is a chain comprised of links or balls.

18. An automatic flush actuator adapted to be mounted on an overflow pipe in a flush tank of a toilet which is original equipment or an existing installation, wherein the tank includes an outlet normally closed by a flapper valve, the automatic flush actuator comprising:

a housing having a coupling for mounting the housing on the overflow pipe;

an operator mounted on the housing and adapted to be coupled to the valve with a first flexible member for allowing the flapper valve to remain closed when in a first mode and for opening the flapper valve when in a second mode;

a motor mounted with the housing and coupled to the operator through a first lost-motion connection for causing the operator to cycle from the first mode to the second mode and back to the first mode, the first lost-motion connection comprising a cam driven by the motor to cycle through two positions corresponding to the first and second modes of the operator, wherein the first lost-motion connection further includes a coupling between the cam and operator, the coupling having a positive connection with the operator when the cam is cycling through the two positions and being decoupled from the cam when the operator is in the first mode, and a second lost-motion connection coupling the operator to the manual flush device for shifting the operator from the first mode to the second mode manually without energizing the motor.

* * * * *